US008710759B1

(12) United States Patent
Isaacson et al.

(10) Patent No.: US 8,710,759 B1
(45) Date of Patent: Apr. 29, 2014

(54) LED ILLUMINATION CONTROL USING A SIMPLE DIGITAL COMMAND STRUCTURE

(75) Inventors: Chris Isaacson, Encinitas, CA (US); Peter Verkaik, Heemstede (NL)

(73) Assignee: NuLEDs, Inc., Vista, CA (US)

( * ) Notice: Subject to any disclaimer, the term of this patent is extended or adjusted under 35 U.S.C. 154(b) by 228 days.

(21) Appl. No.: 13/408,295

(22) Filed: Feb. 29, 2012

Related U.S. Application Data

(63) Continuation-in-part of application No. 12/872,890, filed on Aug. 31, 2010, now Pat. No. 8,344,641.

(60) Provisional application No. 61/238,977, filed on Sep. 1, 2009, provisional application No. 61/589,788, filed on Jan. 23, 2012.

(51) Int. Cl.
*H05B 41/16* (2006.01)

(52) U.S. Cl.
USPC ..... 315/250; 315/292; 315/291

(58) Field of Classification Search
None
See application file for complete search history.

(56) References Cited

U.S. PATENT DOCUMENTS

| | | | | |
|---|---|---|---|---|
| 6,865,428 | B2 * | 3/2005 | Gonzales et al. | 700/86 |
| 7,415,310 | B2 * | 8/2008 | Bovee et al. | 700/9 |
| 7,417,556 | B2 * | 8/2008 | Ling | 340/12.52 |
| 7,427,840 | B2 * | 9/2008 | Morgan et al. | 315/295 |
| 8,207,686 | B2 * | 6/2012 | Sloan | 315/307 |
| 2002/0145394 | A1 * | 10/2002 | Morgan et al. | 315/291 |
| 2004/0158333 | A1 * | 8/2004 | Ha et al. | 700/3 |
| 2008/0164826 | A1 * | 7/2008 | Lys | 315/250 |
| 2008/0164827 | A1 * | 7/2008 | Lys | 315/250 |

* cited by examiner

*Primary Examiner* — Crystal L Hammond
(74) *Attorney, Agent, or Firm* — Robroy R. Fawcett

(57) ABSTRACT

Disclosed is an illumination controller for use with at least one LED module. The illumination controller includes an input, a control output, and a processor. The command input receives at least one illumination control packet. The control output pulse modulates a signal that powers an illumination level. The processor controls the control output in accordance with an illumination level parameter associated with a first illumination control packet received at the input and a scaling parameter associated with a second illumination control packet received at the input.

30 Claims, 7 Drawing Sheets

FIG. 5

500

| 510 Identifier | 520 Description of Parameters | 530 Min | 540 Max |
|---|---|---|---|
| A | Address of Controller to receive cmd | 0 | 15 |
| R | Intensity of R Channel (red) | 0 | 255 |
| G | Intensity of G Channel (green) | 0 | 255 |
| B | Intensity of B Channel (Blue) | 0 | 255 |
| F | Sets fade time in tenths of seconds | 1 | 255 |
| M | Sets fade multipleer | 1 | 255 |
| P | Play internal color loop | 1 | 1 |
| S | Sets Dimscale (scales all channels) | 0 | 255 |
| X | Extended Commands | 1 | 15 |
| <CR> | Carriage Return – Activates Cmd | - | - |

FIG. 6

600

| 610 Identifier | 620 Description of Extended Commands |
|---|---|
| X1 | Increment the Dimscale (all channels) by 5% of full scale |
| X2 | Decrement the Dimscale (all channels) by 5% of full scale |
| X3 | Increment the R channel by 5% of full scale |
| X4 | Decrement the R channel by 5% of full scale |
| X5 | Increment the G channel by 5% of full scale |
| X6 | Decrement the G channel by 5% of full scale |
| X7 | Increment the B channel by 5% of full scale |
| X8 | Decrement the B channel by 5% of full scale |
| X9 | Activate Freeze Mode (If looping, freeze) |
| X10 | Deactivate Freeze Mode (If frozen, resume looping) |
| X11 | Increment Multiplier |
| X12 | Decrement Multiplier |
| X13 | Step to next color in loop |
| X14 | Set "no-break" Dimscale (set Dimscale without stopping fade) |
| X15 | Set "no-break" Multiplier (set Multiplier without stopping fade) |

FIG. 8

| | |
|---|---|
| 810 | A0R255G255B255F30<CR> |
| 820 | A0R0G0B0F20A1R210F40A2G65F60A0<CR> |
| 830 | A3R255G125B62F100<CR> |
| 840 | A0R0G0B0F255M255<CR> |
| 850 | A0X3<CR> |
| 860 | A0S217X14<CR> |
| 870 | A1S255<CR> |

FIG. 9

900

| 910 | 920 | 930 | 940 | 950 | 960 | 970 |
|---|---|---|---|---|---|---|
| SEQ # | Red Level | Green Level | Blue Level | Fade Time | Hold Time | Color Description |
| 1 | 255 | 255 | 255 | 1 | 2 | Ice Cool White |
| 2 | 255 | 255 | 150 | 1 | 2 | White |
| 3 | 255 | 255 | 110 | 1 | 2 | Warm White |
| 4 | 255 | 255 | 70 | 1 | 2 | Ultra Warm White |
| 5 | 255 | 255 | 0 | 3 | 3 | Yellow |
| 6 | 127 | 255 | 0 | 3 | 3 | Yellowish Green |
| 7 | 0 | 255 | 0 | 3 | 3 | Green |
| 8 | 0 | 255 | 127 | 3 | 3 | Bluish Green |
| 9 | 0 | 255 | 255 | 3 | 3 | Cyan |
| 10 | 0 | 127 | 255 | 3 | 3 | Greenish Blue |
| 11 | 0 | 0 | 255 | 3 | 3 | Blue |
| 12 | 127 | 0 | 255 | 3 | 3 | Purple |
| 13 | 255 | 0 | 255 | 3 | 3 | Fuscia |
| 14 | 255 | 0 | 127 | 3 | 3 | Hot Pink |
| 15 | 255 | 0 | 0 | 3 | 3 | Red |
| 16 | 255 | 127 | 0 | 3 | 3 | Orange |

LED ILLUMINATION CONTROL USING A SIMPLE DIGITAL COMMAND STRUCTURE

CROSS-REFERENCE TO RELATED APPLICATIONS

This application is a continuation-in-part of U.S. patent application Ser. No. 12/872,890, filed Aug. 31, 2010 now U.S. Pat. No. 8,344,641, which application claims the benefit of U.S. Provisional Application No. 61/238,977, filed Sep. 1, 2009, and which applications are incorporated herein by reference. This application also claims the benefit of U.S. Provisional Application No. 61/589,788, filed Jan. 23, 2012, which application is incorporated herein by reference.

BACKGROUND OF THE INVENTION

1. Field of the Invention

The present invention relates to light-emitting diode (LED) illumination control using a simple digital command structure.

2. Description of the Prior Art and Related Information

LED illumination control is often accomplished by the modification of existing illumination control systems largely developed for AC incandescent lamps or similar devices. Such systems have relatively complicated command structures and modalities.

An example of an existing digital interface for illumination control system is DALI which is an acronym for Digital Addressable Lighting Interface. DALI typically uses a two-byte command having an address byte and a control byte. The data rate is typically 1200 bits per second. The control byte can have one of 512 different values, each representing distinct operations. Such digital interface may require several commands to accomplish relatively simple LED illumination control.

There is, therefore, a need for relatively simple technique for LED illumination control. The present invention provides the methods and apparatuses to meet these needs.

SUMMARY OF THE INVENTION

The present invention may be embodied in an illumination controller for use with at least one three-color LED module. The illumination controller includes an input, three color control outputs, and a processor. The input receives at least one illumination control packet. The first color control output pulse modulates a first signal that powers a first illumination level for a first color The second color control output pulse modulates a second signal that powers a second illumination level for a second color. The third color control output pulse modulates a third signal that powers a third illumination level for a third color. The processor controls the first color control output in accordance with a first color level parameter associated with a first illumination control packet received at the input and a scaling parameter associated with a second illumination control packet received at the input, controls the second color control output in accordance with a second color level parameter associated with the first illumination control packet and the scaling parameter; and controls the third color control output in accordance with the third color level parameter associated with the first illumination control packet and the scaling parameter. The three colors may be red, green, and blue.

In more detailed features of the invention, the first color control output may use pulse frequency modulation based on the first color level parameter and may use pulse width modulation based on the scaling parameter for pulse modulating the first signal, the second color control output may use pulse frequency modulation based on the second color level parameter and may use pulse width modulation based on the scaling parameter for pulse modulating the second signal, and the third color control output may use pulse frequency modulation based on the third color level parameter and may use pulse width modulation based on the scaling parameter for pulse modulating the third signal.

In other more detailed features of the invention, the first, second and third signals may be below 24 volts. Each of the first and second illumination control packets may include an ASCII string, and the processor may control the color control outputs in response to receiving an illumination control packet including a carriage return character. The scaling parameter may correspond to an illumination scaling that is greater than zero. The command input may be a serial interface such as an RS-232 interface, an RS-485 interface, or an Ethernet interface such as a Power over Ethernet (PoE) interface. Further, the command input may be a wireless interface.

In other more detailed features of the invention, the illumination controller may further include a fourth color control output for pulse modulating a fourth signal that powers a fourth illumination level for a fourth color. The processor may control the fourth color control output in accordance with the fourth color level parameter associated with the first illumination control packet and the scaling parameter. The fourth color control output may use pulse frequency modulation based on the fourth color level parameter and may use pulse width modulation based on the scaling parameter for pulse modulating the fourth signal. The fourth color may be amber.

The present invention also may be embodied in a method for controlling at least one three-color LED module. In the method, a first illumination control packet having at least a first color level parameter, a second color level parameter, and a third color level parameter is received. Also, a second illumination control packet having at least a scaling parameter is received. A processor controls a first color control output to pulse modulate a first signal that powers a first illumination level for a first color in accordance with the first color level parameter and the scaling parameter, controls a second color control output to pulse modulate a second signal that powers a second illumination level for a second color in accordance with the second color level parameter and the scaling parameter, and controls a third color control output to pulse modulate a third signal that powers a third illumination level for a third color in accordance with the third color level parameter and scaling parameter.

The present invention also may be embodied in an apparatus for controlling at least one three-color LED module. The apparatus includes means for receiving a means for receiving a first illumination control packet having at least a first color level parameter, a second color level parameter, and a third color level parameter; means for receiving a second illumination control packet having at least a scaling parameter; means for controlling a first color control output to pulse modulate a first signal that powers a first illumination level for a first color in accordance with the first color level parameter and the scaling parameter; means for controlling a second color control output to pulse modulate a second signal that powers a second illumination level for a second color in accordance with the second color level parameter and the scaling parameter; and means for controlling a third color control output to pulse modulate a third signal that powers a third illumination level for a third color in accordance with the third color level parameter and scaling parameter.

Further, the present invention may be embodied in a computer program product comprising computer readable medium storing: code for causing a computer to receive a first illumination control packet having at least a first color level parameter, a second color level parameter, and a third color level parameter; code for causing a computer to receive a second illumination control packet having at least a scaling parameter; code for causing a computer to control a first color control output to pulse modulate a first signal that powers a first illumination level for a first color in accordance with the first color level parameter and the scaling parameter; code for causing a computer to control a second color control output to pulse modulate a second signal that powers a second illumination level for a second color in accordance with the second color level parameter and the scaling parameter; and code for causing a computer to control a third color control output to pulse modulate a third signal that powers a third illumination level for a third color in accordance with the third color level parameter and scaling parameter.

Further, the present invention may be embodied in an illumination controller for use with at least one LED module. The illumination controller includes an input, a control output, and a processor. The input receives at least one illumination control packet. The control output pulse modulates a signal that powers an illumination level. The processor controls the control output in accordance with an illumination level parameter associated with a first illumination control packet received at the input and a scaling parameter associated with a second illumination control packet received at the input. The control output may use pulse frequency modulation based on the illumination level parameter and may use pulse width modulation based on the scaling parameter for modulating the signal.

The present invention also may be embodied in a method for controlling at least one LED module. In the method, a first illumination control packet having at least one illumination level parameter is received. A second illumination control packet having at least a scaling parameter is received. A processor controls a control output to pulse modulate a signal that powers an illumination level in accordance with an illumination level parameter associated with the first illumination control packet and the scaling parameter.

The present invention also may be embodied in an apparatus for controlling at least one LED module, comprising: means for receiving a first illumination control packet having at least one illumination level parameter; means for receiving a second illumination control packet having a at least scaling parameter; and means for controlling a control output to pulse modulate a signal that powers an illumination level in accordance with an illumination level parameter associated with the first illumination control packet and the scaling parameter.

BRIEF DESCRIPTION OF THE DRAWINGS

The accompanying drawings illustrate embodiments of the present invention and, together with the description, serve to explain the principles of the invention.

FIG. 5 is a table of command parameters for use in an illumination control packet.

FIG. 6 is a table of extended commands for use in an illumination control packet.

FIG. 8 is a list of sample ASCII strings for used in defining parameters in an illumination control packet.

FIG. 9 is a table of a pre-programmed illumination sequence.

DETAILED DESCRIPTION

Figure 1:
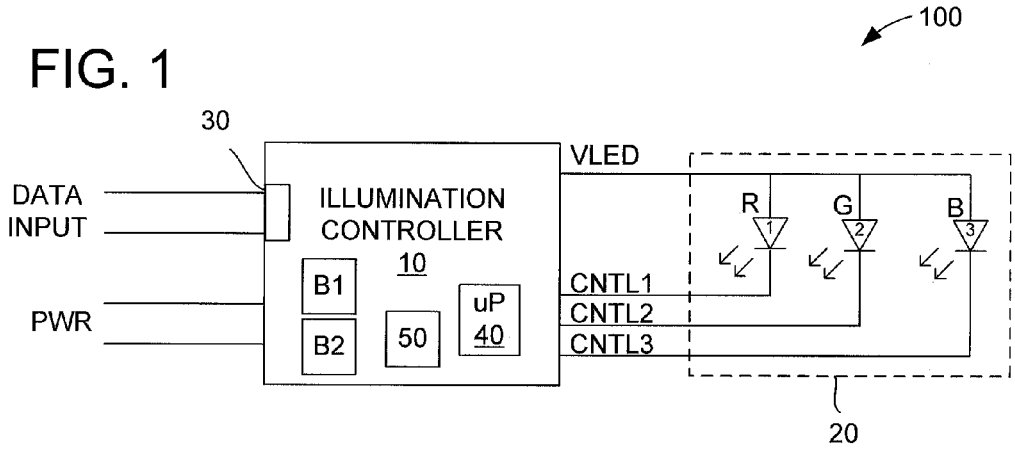
FIG. 1 is a schematic block diagram illustrating an illumination controller, according to the present invention.
Figure 2:
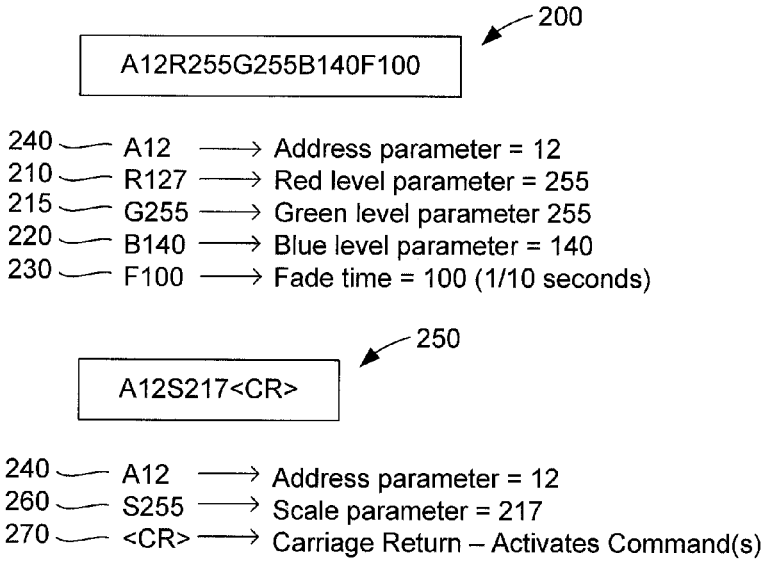
FIG. 2 is a schematic diagram illustrating a first and second illumination control packets, according to the present invention.
Figure 3:
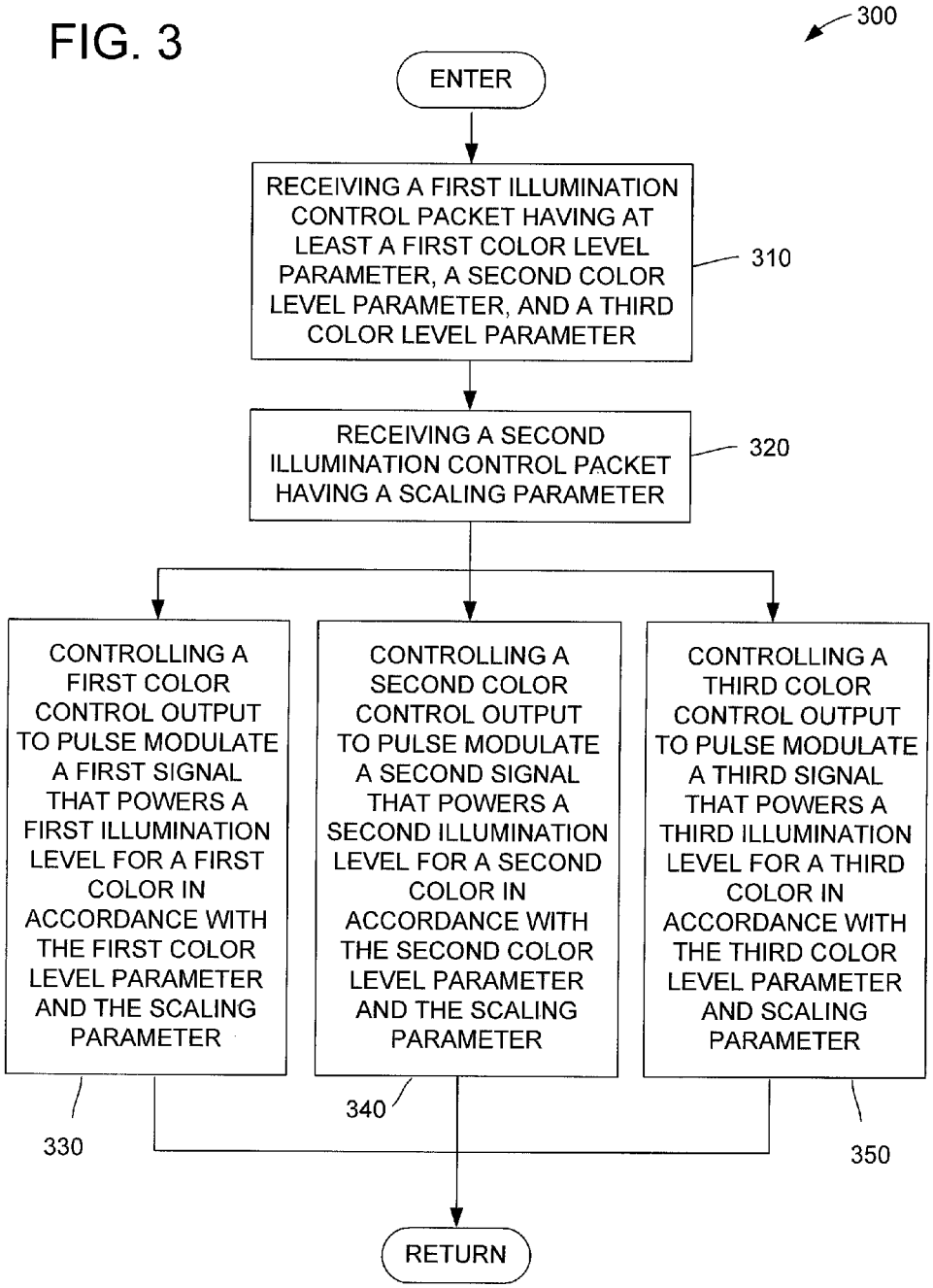
FIG. 3 is a flow diagram illustrating a method for three-color LED illumination control, according to the present invention.

With reference to FIGS. 1-3, the present invention may be embodied in an illumination controller 10 (FIG. 1) for use with at least one three-color LED module 20. The illumination controller includes an input 30, three color control outputs, CNTL1, CNTL2, and CNTL3, and a processor 40. The input 30 receives at least one illumination control packet 200 and/or 250 (FIG. 2). The first color control output CNTL1 pulse modulates a first signal that powers a first illumination level for a first color The second color control output CNTL2 pulse modulates a second signal that powers a second illumination level for a second color. The third color control output CNTL3 pulse modulates a third signal that powers a third illumination level for a third color. The processor controls the first color control output in accordance with a first color level parameter 210 associated with a first illumination control packet 200 received at the input 30 and a scaling parameter 260 associated with a second illumination control packet 250 received at the input, controls the second color control output in accordance with a second color level parameter 215 associated with the first illumination control packet and the scaling parameter 260; and controls the third color control output in accordance with the third color level parameter 220 associated with the first illumination control packet and the scaling parameter 260. The three colors may be red R, green G, and blue B.

The first, second and third signals may be below 24 volts. Each of the first and second illumination control packets 200 may include an ASCII string that may be activated when the processor 40 receives a carriage return character. The scaling parameter may correspond to an illumination scaling greater than zero.

The input 30 may be a serial interface such as an RS-232 interface, an RS-485 interface, or an Ethernet interface such as a Power over Ethernet (PoE) interface. Further, the input may be a wireless interface.

Figure 4:
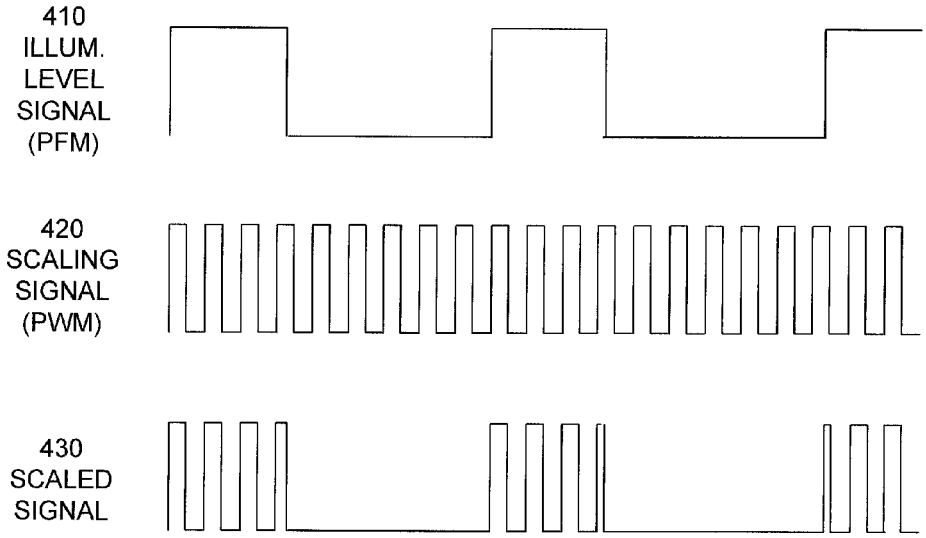
FIG. 4 is a graph showing an illumination level signal further modulated by a scaling signal to generate a scaled signal, according to the present invention.

With reference to FIG. 4, the first color control output CNTL1 may use pulse frequency modulation based on the first color level parameter 210 and may use pulse width modulation based on the scaling parameter 260 for pulse modulating the first signal. The color level parameter may be used for defining an illumination level signal 410, which may be based on pulse frequency moducation (PFM) to implement the illumination level. The illumination level signal 410 may be modulated by a scaling signal 420 according to the scaling parameter 260 to generate a scaled signal 430. The scaling signal may use pulse width modulation (PWM) having a duty cycle from 0% (off or no illumination) to 100% (full illumination in accordance with the illumination level defined with the color level parameter). Similarly, the second color control output CNTL2 may use pulse frequency modulation based on the second color level parameter 215 and may use pulse width modulation based on the scaling parameter 260 for pulse modulating the second signal, and the third color control output CNTL3 may use pulse frequency modulation based on the third color level parameter 220 and may use pulse width modulation based on the scaling parameter 260 for pulse modulating the third signal.

The scaling parameter may be used to maintain the look of a lighting scene while at the same time uniformly lowering or dimming the illumination level. One use could be to lower the power consumption of an LED module 20, in response to, for example, a need for a building to lowers its power consumption based on supply or economic considerations. By setting the scaling factor to, for example, 85% (a 15% dimming), a proportionate decrease in power consumption (about 15%) for the building's illumination may be achieved.

The illumination controller may further include a fourth color control output (not shown) for pulse modulating a fourth signal that powers a fourth illumination level for a fourth color. The processor may control the fourth color control output in accordance with the fourth color level parameter associated with the first illumination control packet and the scaling parameter 260. The fourth color control output may use pulse frequency modulation based on the fourth color level parameter and may use pulse width modulation based on the scaling parameter for pulse modulating the fourth signal. The fourth color may be amber.

The present invention also may be embodied in a method 300 for controlling at least one three-color LED module 20. In the method, a first illumination control packet 200 having at least a first color level parameter 210, a second color level parameter 215, and a third color level parameter 220 is received (step 310). Also, a second illumination control packet 250 having at least a scaling parameter 260 is received (step 315). A processor 40 controls a first color control output to pulse modulate a first signal that powers a first illumination level for a first color in accordance with the first color level parameter and the scaling parameter (step 320), controls a second color control output to pulse modulate a second signal that powers a second illumination level for a second color in accordance with the second color level parameter and the scaling parameter (step 330), and controls a third color control output to pulse modulate a third signal that powers a third illumination level for a third color in accordance with the third color level parameter and scaling parameter (step 340).

The present invention also may be embodied in an apparatus 10 for controlling at least one three-color LED module. The apparatus includes means 30 for receiving a first illumination control packet 200 having at least a first color level parameter 210, a second color level parameter 215, and a third color level parameter 220; means 30 for receiving a second illumination control packet 250 having at least a scaling parameter 260; means 40 for controlling a first color control output to pulse modulate a first signal that powers a first illumination level for a first color in accordance with the first color level parameter and the scaling parameter; means 40 for controlling a second color control output to pulse modulate a second signal that powers a second illumination level for a second color in accordance with the second color level parameter and the scaling parameter; and means 40 for controlling a third color control output to pulse modulate a third signal that powers a third illumination level for a third color in accordance with the third color level parameter and scaling parameter.

Further, the present invention may be embodied in a computer program product comprising computer readable medium 50 storing: code for causing a computer 10 (e.g., illumination controller 10) to receive a first illumination control packet 200 having at least a first color level parameter 210, a second color level parameter 215, and a third color level parameter 220; code for causing a computer 10 to receive a second illumination control packet 250 having at least a scaling parameter 260; code for causing a computer 10 to control a first color control output to pulse modulate a first signal that powers a first illumination level for a first color in accordance with the first color level parameter and the scaling parameter; code for causing a computer 10 to control a second color control output to pulse modulate a second signal that powers a second illumination level for a second color in accordance with the second color level parameter and the scaling parameter; and code for causing a computer 10 to control a third color control output to pulse modulate a third signal that powers a third illumination level for a third color in accordance with the third color level parameter and scaling parameter.

The illumination controller 10 may provide RGB LED color control for a single lighting zone in smaller to mid-sized architectural spaces. The controller and the LED module(s) 20 may form one addressable segment 100 of a plurality of individually addressable and controllable segments corresponding to respective lighting zones. The controller may control common anode RGB components with input voltages below 24 volts (or it can alternatively control 3 separate single color LED strings simultaneously). The illumination controller utilizes pulse frequency modulation (PFM) to create smooth color fades and a logarithmic algorithm for more accurate color matching of eight-bit (256 level) RGB values. The illumination control packets 200 and 250 may include an address parameter for specifying the address for the respective illumination controller.

Further, the present invention may be embodied in an illumination controller 10 for use with at least one LED module 20. The illumination controller includes an input 30, a control output CNTL1, and a processor 40. The command input receives at least one illumination control packet. The control output pulse modulates a signal that powers an illumination level. The processor controls the control output in accordance with an illumination level parameter associated with a first illumination control packet received at the input and a scaling parameter associated with a second illumination control packet received at the input. The control output may use pulse frequency modulation based on the illumination level parameter and may use pulse width modulation based on the scaling parameter for modulating the signal.

Figure 7:
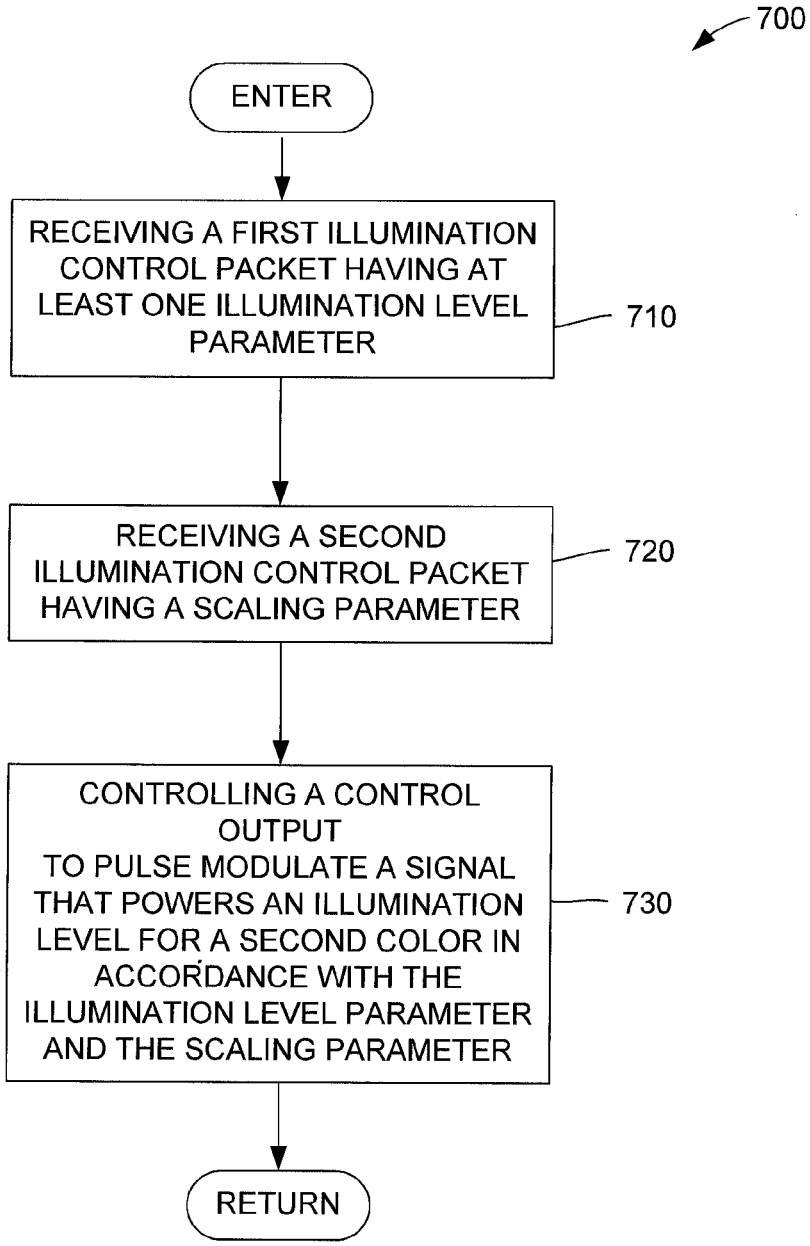
FIG. 7 is a flow diagram illustrating a method for LED illumination control, according to the present invention.

With reference to FIG. 7, the present invention also may be embodied in a method 700 for controlling at least one LED module 20. In the method, a first illumination control packet having at least one illumination level parameter is received (step 710). A second illumination control packet having at least a scaling parameter is received (step 720). A processor controls a control output CNTL1 to pulse modulate a signal that powers an illumination level in accordance with an illumination level parameter associated with the first illumination control packet and the scaling parameter (step 730).

The present invention also may be embodied in an apparatus 10 for controlling at least one LED module 20, comprising: means 30 for receiving a first illumination control packet 200 having at least one illumination level parameter 210; means 30 for receiving a second illumination control 250 packet having a at least scaling parameter 260; and means 40 for controlling a control output CNTL1 to pulse modulate a signal that powers an illumination level in accordance with an illumination level parameter associated with the first illumination control packet and the scaling parameter.

Sample ASCII strings for use in an illumination control packet are shown in FIG. 8, using the parameters shown in FIGS. 5 and 6. The string 810 may set the intensity or illumination level of the R, G, and B channels to 255 (full on) over 3 seconds (address 0 is a default to address all controllers). The string 820 may set the levels of all channels on all address to zero (all off) over 2 seconds while simultaneously setting the R channel of address 1 to 210 over 4 seconds, and the G channel of address 2 to 65 over 6 seconds. The A0 at the end commands all of the illumination controllers 10 to accept the carriage return (otherwise, only the illumination controller with the address A2 would execute based on the carriage return). String 830 may set, on address 3, the R channel to 255, the G channel to 125, and the B channel to 62, over 10 seconds. All other channels of all other addresses would remain unchanged. The string 840 may fade all channels on all addresses to zero in 6502.5 seconds (108 minutes, 22.5 second). The M parameter should be reset to 1 afterward in a new command line: A0M1<CR>. The string 850 may reduce the intensity level of the R channel on all addresses by 5% of full scale (5% of 255~13). The last fade time stored in each controller is used. The string 860 may set the dimscale or scaling parameter of all addresses to 85% without stopping the fade or loop (no break). The string 870 may set the dimscale of address 1 to 100%. Looping or fading would stop.

All parameters in the strings may be stored and remain in the memory of the target controller until changed or power is removed. This includes the F (fade time), M (fade multipler), and S (scaling or dimscale) parameters, so a user must be cognizant of the parameters previously sent. Unexpected results may occur if parameters are not reset on subsequent commands. Advantageously, the current illumination parameter(s) and/or state(s) for a lighting scene may be made available by an illumination controller 10 for local readout or for transmission based on, for example, a remote inquiry.

Virtually any lighting scene imaginable may be created using command packets by combining sequences of strings with the parameters to set the desired illumination level(s) and effect(s). Strings and packets may be invoked by touchpads, sensors, scheduled events, etc. Using macros, dynamic lightshows can be realized. Extended (X) commands may allow an end user to make ready adjustments to an existing lighting scene.

The illumination controller 10 may be wall mounted and may be installed in a standard single-gang electrical box (advantageously separate from any AC line voltage wiring) and may be manually operated with only two front panel buttons. A power supply may be separate and should be specifically matched to the LED system being driven.

The illumination controller 10 may include a 6-position screw terminal connector. Typical screw positions may be labeled Vin, GND, Vout, R, G, B. Multiple parallel LED components may be wired in the same terminal block as long as the voltage requirements are compatible. Vin and GND are for the DC input from the power supply. (typically 6 volt minimum to 24 volt maximum) matched to the LED system. Vout may be for a common anode of the LED system. Further, R is for the Red channel, G is for the Green channel, and B is for the Blue channel.

The processor 40 may be a configurable communications controller, such as part number SX28AC/SS-G available from Parallax Inc. of Rocklin, Calif. The control outputs may each be implemented using a power MOSFET, such as part number FDP7030BL available from Fairchild Semiconductor of San Jose, Calif.

Manual operation of the illumination controller 10 may be accomplished using two buttons, B1 and B2, and a predefined sequence of colors that will be displayed in a continuous loop (Loop Mode) at variable speeds. The sequence can be frozen (Freeze Mode) at any point in the loop.

Button 1 (the top button) toggles between Loop Mode and Freeze Mode. Button 2 (the bottom button) has different functions depending on the Mode. Upon power-up, the illumination controller is in Loop Mode with the pre-defined fade and hold times.

In Loop Mode, Button 2 acts as a time multiplier. Every time Button 2 is pressed (and released) in Loop Mode, the fade times and hold times are doubled until the multiplier is 32 (2, 4, 8, 16, 32). Then the multiplier goes back to 1 on the next press and release. To get directly back to a multiplier of 1 from any given multiplier, press and hold Button 2 for two seconds, then release. At any time during Loop Mode, a press and release of Button 1 will freeze the display (even in the middle of a color fade) and hold on that color indefinitely until another press of a button. While in Freeze Mode, each press and release of Button 2 will skip to the next defined color and stay there indefinitely until another press of a button.

To exit Freeze Mode and return to Loop Mode, press and release Button 1. The loop will fade to the next color in the sequence and continue looping through the sequence with the time multiplier set before entering Freeze Mode. After multiple button presses, to determine which settings are current, a press and release of Button 2 will indicate whether or not the illumination controller is in Freeze Mode or Loop Mode (the colors will change with each press and release in Freeze Mode). If it is in Loop Mode, pressing and holding Button 2 for two seconds, then releasing, will to return to the default settings.

Fade time is the time it takes to reach the defined color from the previous color (1 to 60 seconds). Hold time is the time the color stays static before the fade to the next color (0.1 to 60 seconds). Set the fade and hold times to the shortest times you will possibly want and adjust later with the multiplier. Times may be defined to the nearest tenth of a second (e.g. 6.7 seconds).

With reference to FIG. 9, a sequence 910 may be stored as a table 900 in the processor 40, or in a computer readable medium 50. Each step of the sequence has a red level value 920, a green level value 930, a blue level value 940, a fade time value 950, and a hold time value 960. The RGB levels correspond to a color description 970.

The illumination controller may be extended to add control for a fourth color, such as amber, for a richer color selection. In such case, an amber level parameter would be added to the illumination control packet 200.

Those of skill would further appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention.

The various illustrative logical blocks, modules, and circuits described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the embodiments disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

In one or more exemplary embodiments, the functions described may be implemented in hardware, software, firmware, or any combination thereof. If implemented in software as a computer program product, the functions may be stored as one or more instructions or code on a computer-readable medium. A storage media may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to store desired program code in the form of instructions or data structures and that can be accessed by a computer. The computer-readable medium may be non-transitory such that it does not include a transitory, propagating signal.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. An illumination controller for use with at least one three-color LED module, comprising:

an input for receiving at least one illumination control packet;

a first color control output for pulse modulating a first signal that powers a first illumination level for a first color;

a second color control output for pulse modulating a second signal that powers a second illumination level for a second color;

a third color control output for pulse modulating a third signal that powers a third illumination level for a third color; and a processor that controls the first color control output in accordance with a first color level parameter associated with a first illumination control packet received at the input and a scaling parameter associated with a second illumination control packet received at the input, controls the second color control output in accordance with a second color level parameter associated with the first illumination control packet and the scaling parameter; and controls the third color control output in accordance with the third color level parameter associated with the first illumination control packet and the scaling parameter.

2. An illumination controller as defined in claim 1, wherein:

the first color control output uses pulse frequency modulation based on the first color level parameter and uses pulse width modulation based on the scaling parameter for pulse modulating the first signal;

the second color control output uses pulse frequency modulation based on the second color level parameter and uses pulse width modulation based on the scaling parameter for pulse modulating the second signal; and the third color control output uses pulse frequency modulation based on the third color level parameter and uses pulse width modulation based on the scaling parameter for pulse modulating the third signal.

3. An illumination controller as defined in claim 1, wherein the first color is red, the second color is green, and the third color is blue.

4. An illumination controller as defined in claim 1, wherein first, second and third signals are below 24 volts.

5. An illumination controller as defined in claim 1, wherein each of the first and second illumination control packets include an ASCII string.

6. An illumination controller as defined in claim 1, wherein the processor controls the first, second and third color control outputs in response to receiving an illumination control packet including a carriage return character.

7. An illumination controller as defined in claim 1, wherein the scaling parameter corresponds to an illumination scaling that is greater than zero.

8. An illumination controller as defined in claim 1, wherein input is a serial interface.

9. An illumination controller as defined in claim 8, wherein the serial interface is an RS-232 interface.

10. An illumination controller as defined in claim 8, wherein the serial interface is an RS-485 interface.

11. An illumination controller as defined in claim 8, wherein the serial interface is an Ethernet interface.

12. An illumination controller as defined in claim 1, wherein input is a wireless interface.

13. An illumination controller as defined in claim 1, further comprising:

a fourth color control output for pulse modulating a fourth signal that powers a fourth illumination level for a fourth color; and wherein:

the processor controls the fourth color control output in accordance with the fourth color level parameter associated with the first illumination control packet and the scaling parameter.

14. An illumination controller as defined in claim 13, wherein:

the fourth color control output uses pulse frequency modulation based on the fourth color level parameter and uses pulse width modulation based on the scaling parameter for pulse modulating the fourth signal.

15. An illumination controller as defined in claim 13, wherein the first color is red, the second color is green, the third color is blue, and the fourth color is amber.

16. A method for controlling at least one three-color LED module, comprising:

receiving a first illumination control packet having at least a first color level parameter, a second color level parameter, and a third color level parameter;

receiving a second illumination control packet having at least a scaling parameter;

a processor controlling a first color control output to pulse modulate a first signal that powers a first illumination level for a first color in accordance with the first color level parameter and the scaling parameter;

a processor controlling a second color control output to pulse modulate a second signal that powers a second illumination level for a second color in accordance with the second color level parameter and the scaling parameter; and a processor controlling a third color control output to pulse modulate a third signal that powers a third illumination level for a third color in accordance with the third color level parameter and scaling parameter.

17. A method for controlling as defined in claim 16, wherein:

the first color control output uses pulse frequency modulation based on the first color level parameter and uses pulse width modulation based on the scaling parameter to pulse modulate the first signal;

the second color control output uses pulse frequency modulation based on the second color level parameter and uses pulse width modulation based on the scaling parameter to pulse modulate the second signal; and the third color control output uses pulse frequency modulation based on the third color level parameter and uses pulse width modulation based on the scaling parameter to pulse modulate the third signal.

18. A method for controlling as defined in claim 16, wherein the first color is red, the second color is green, and third color is blue.

19. A method for controlling as defined in claim 16, wherein each of the first and second illumination control packets include an ASCII string.

20. A method for controlling as defined in claim 16, wherein the scaling parameter corresponds to an illumination scaling that is greater than zero.

21. A method for controlling as defined in claim 16, wherein:

the first illumination control packet further has a fourth color control parameter:

an the method further comprises a processor controlling a fourth color control output to pulse modulate a fourth signal that powers a fourth illumination level for a fourth color in accordance with the fourth color level parameter and the scaling parameter.

22. A method for controlling as defined in claim 21, wherein:

the fourth color control output uses pulse frequency modulation based on the fourth color level parameter and uses pulse width modulation based on the scaling parameter to pulse modulate the fourth signal.

23. A method for controlling as defined in claim 21, wherein the first color is red, the second color is green, the third color is blue, and the fourth color is amber.

24. Apparatus for controlling at least one three-color LED module, comprising:

means for receiving a first illumination control packet having at least a first color level parameter, a second color level parameter, and a third color level parameter;

means for receiving a second illumination control packet having at least a scaling parameter;

means for controlling a first color control output to pulse modulate a first signal that powers a first illumination level for a first color in accordance with the first color level parameter and the scaling parameter;

means for controlling a second color control output to pulse modulate a second signal that powers a second illumination level for a second color in accordance with the second color level parameter and the scaling parameter; and means for controlling a third color control output to pulse modulate a third signal that powers a third illumination level for a third color in accordance with the third color level parameter and scaling parameter.

25. A computer program product comprising:

computer readable medium storing:

code for causing a computer to receive a first illumination control packet having at least a first color level parameter, a second color level parameter, and a third color level parameter;

code for causing a computer to receive a second illumination control packet having at least a scaling parameter;

code for causing a computer to control a first color control output to pulse modulate a first signal that powers a first illumination level for a first color in accordance with the first color level parameter and the scaling parameter;

code for causing a computer to control a second color control output to pulse modulate a second signal that powers a second illumination level for a second color in accordance with the second color level parameter and the scaling parameter; and code for causing a computer to control a third color control output to pulse modulate a third signal that powers a third illumination level for a third color in accordance with the third color level parameter and scaling parameter.

26. An illumination controller for use with at least one LED module, comprising:

an input for receiving at least one illumination control packet;

a control output for pulse modulating a signal that powers an illumination level; and a processor that controls the control output in accordance with an illumination level parameter associated with a first illumination control packet received at the input and a scaling parameter associated with a second illumination control packet received at the input.

27. An illumination controller as defined in claim 26, wherein the control output uses pulse frequency modulation based on the illumination level parameter and uses pulse width modulation based on the scaling parameter for modulating the signal.

28. A method for controlling at least one LED module, comprising:

receiving a first illumination control packet having at least one illumination level parameter;

receiving a second illumination control packet having a at least scaling parameter; and a processor controlling a control output to pulse modulate a signal that powers an illumination level in accordance with an illumination level parameter associated with the first illumination control packet and the scaling parameter.

29. A method for controlling as defined in claim 28, wherein:

the control output uses pulse frequency modulation based on the illumination level parameter and uses pulse width modulation based on the scaling parameter to pulse modulate the signal.

30. An apparatus for controlling at least one LED module, comprising:

means for receiving a first illumination control packet having at least one illumination level parameter;

means for receiving a second illumination control packet having a at least scaling parameter; and means for controlling a control output to pulse modulate a signal that powers an illumination level in accordance with an illumination level parameter associated with the first illumination control packet and the scaling parameter.

* * * * *